US005787623A

United States Patent [19]

Schutz

[11] Patent Number: 5,787,623

[45] Date of Patent: Aug. 4, 1998

[54] LETTERING PLATE FOR PALLET CONTAINERS

[75] Inventor: Udo Schutz, Selters, Germany

[73] Assignee: Protechna S.A., Fribourg, Switzerland

[21] Appl. No.: 724,917

[22] Filed: Oct. 2, 1996

[30] Foreign Application Priority Data

Oct. 10, 1995 [DE] Germany ..... 195 37 490.8

[51] Int. Cl.[6] ..... G09F 3/18

[52] U.S. Cl. ..... 40/661.08; 40/642.02; 40/308; 411/40; 411/54

[58] Field of Search ..... 40/308, 642.02, 40/651, 661.08, 663, 666; 411/39, 40, 54

[56] References Cited

U.S. PATENT DOCUMENTS

| | | | |
|---|---|---|---|
| 1,397,917 | 11/1921 | Behrman | 40/663 |
| 2,723,474 | 11/1955 | Minter | 40/308 X |
| 3,287,841 | 11/1966 | Spragg et al. | 40/308 |
| 4,217,711 | 8/1980 | Spresser et al. | 40/308 |
| 5,363,575 | 11/1994 | Sawyer et al. | 40/308 |

FOREIGN PATENT DOCUMENTS 38 39 647 10/1992 Germany .

2 277 188 10/1994 United Kingdom .

*Primary Examiner*—Brian K. Green

*Attorney, Agent, or Firm*—Young & Thompson

[57] ABSTRACT

Lettering plate (10) which is to be attached to the outside of a lattice jacket of a pallet container has a lower support edge (14) which is flanged or bevelled to the outside. The lower support edge abuts horizontal lattice rod (8) and reaches behind it. Two side edges (15, 16) of the lettering plate are flanged to the outside for resting on two vertical lattice rods (9). Openings (18) are provided in center section (17) of two side edges (15, 16) to hold horizontal lattice rod (8). The lettering plate (10) also has an upper edge (19) which is made as a clawed edge and which in the mounted state fits behind horizontal lattice rod (8) thereby resiliently bracing plate (10) against horizontal lattice rod (8). The horizontal lattice rod abuts the back of the plate in a middle plate section. The lower and upper edge (14, 15) have, depending on the size of lettering plate (10) and the grid division of the lattice jacket, one or more openings for holding one or more vertical lattice rods (9). The plate (10) can be equipped with a seal of originality.

3 Claims, 6 Drawing Sheets

LETTERING PLATE FOR PALLET CONTAINERS

FIELD OF THE INVENTION

The invention relates to lettering plates for pallet containers of the type described in DE 38 39 647 C2 for transportation and storage of liquids, which are equipped with a flat pallet, an interchangeable inner container of plastic with an upper sealable fill opening and a lower drain opening with a discharge means, and an outer jacket which surrounds the inner container and which consists of vertical and horizontal metal lattice bars which support the plastic inner container which is filled with liquid, the lattice bars which are made as pipes being recessed at the intersection points to form trough-like, double walled depressions which run in the longitudinal direction of the lattice bars such that the lattice bars which are welded to one another at the intersection points lie almost in one plane.

BACKGROUND OF THE INVENTION

In generic pallet containers the lettering plates are attached to the four corners with sheet metal screws on the outside of the lattice jacket, the sheet metal screws being screwed at four intersection points of one horizontal and one vertical lattice rod at a time through the lettering plate in the horizontal lattice rod. Screwing the lettering plates to the lattice jacket of the pallet container is time-consuming and makes assembly costs higher. Furthermore, the lettering plates can be illicitly unscrewed with ease.

SUMMARY OF THE INVENTION

The object of the invention is to develop a lettering plate for pallet containers of the generic type which can be easily and quickly mounted and can be secured against illicit removal by a seal of originality.

This object is achieved according to the invention by a lettering plate having the features recited in the appended claims.

The lettering plate according to the invention embodies a simple and feasible achievement of this object.

BRIEF DESCRIPTION OF THE DRAWINGS

The invention is explained below using drawings of two embodiments.

DETAILED DESCRIPTION OF THE INVENTION

Figure 1:
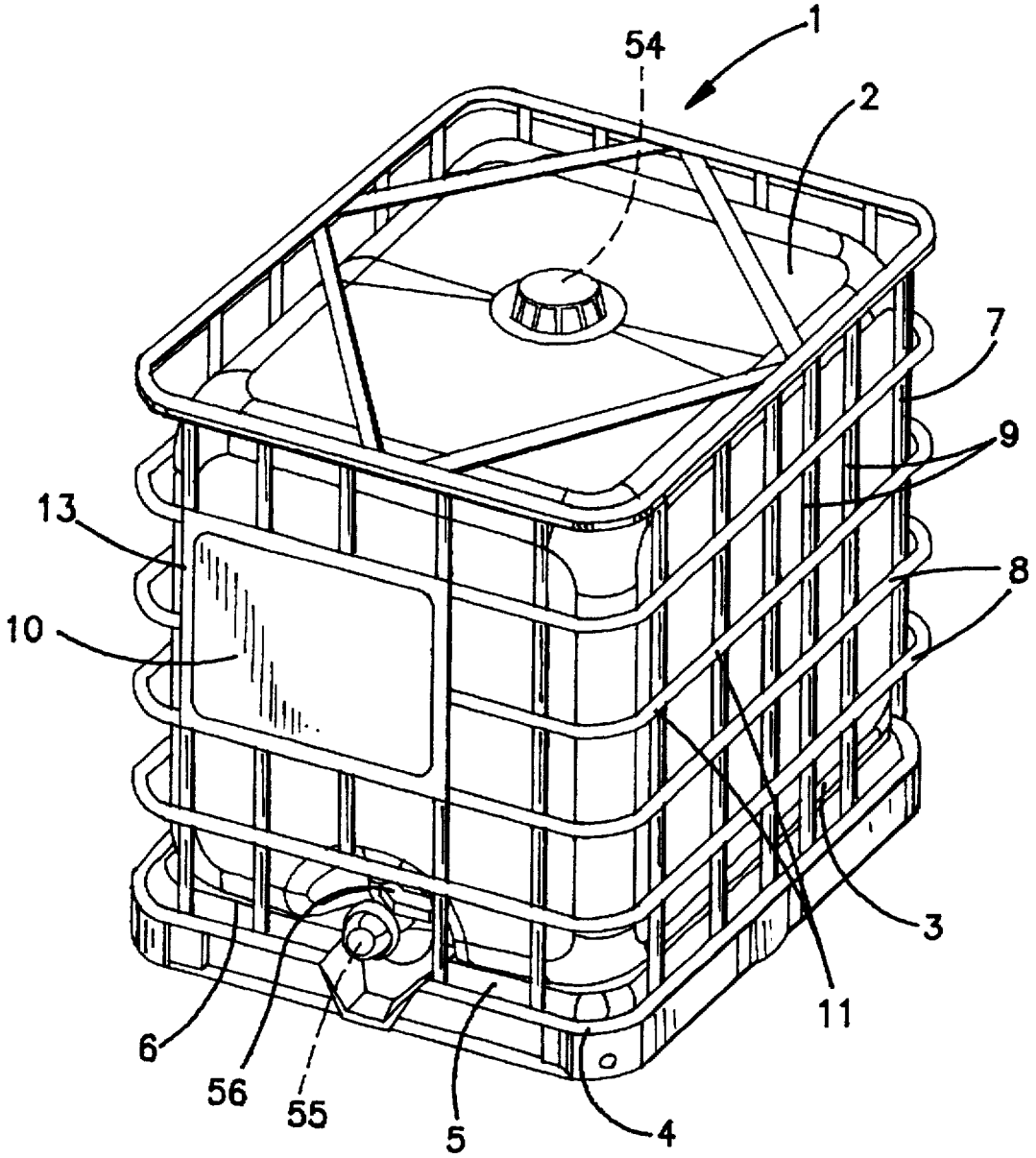
FIG. 1 shows a perspective drawing of a pallet container with a lettering plate.

Pallet container 1 which can be used as a one-way and returnable container according to FIG. 1 for transportation and storage of liquids has, as the main components, cuboidal, blow-molded inner container 2 of plastic with drain bottom 3, sealable fill opening 54 and lower drain opening 55 with drain cock 56, pallet 4 which is made as bottom trough 5 of sheet metal with drain bottom 6 for form-fitted holding of inner container 2, and lattice jacket 7 which abuts inner container 2, which consists of crossing horizontal and vertical lattice rods 8, 9 of metal, and to which lettering plate 10 of sheet metal is attached.

Figure 8:
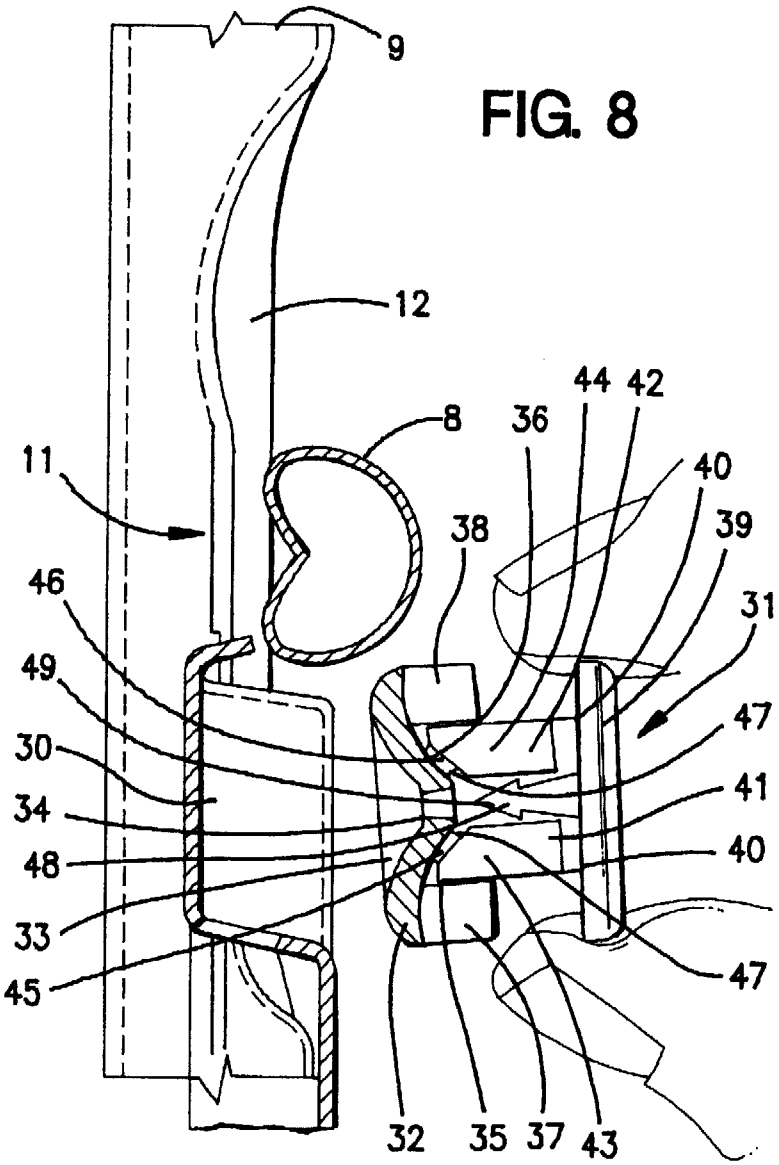
FIG. 8 shows a section through the depression in the lettering plate according to line VIII—VIII of FIG. 6 and a longitudinal section of the seal of originality before insertion into the lettering plate.

Horizontal and vertical lattice rods 8, 9 at intersection points 11 are recessed to form trough-like double-walled depressions 12 which run in the longitudinal direction of the rods such that lattice rods 8, 9 welded to one another at intersection points 11 lie roughly in one plane (FIG. 8).

Figure 3:
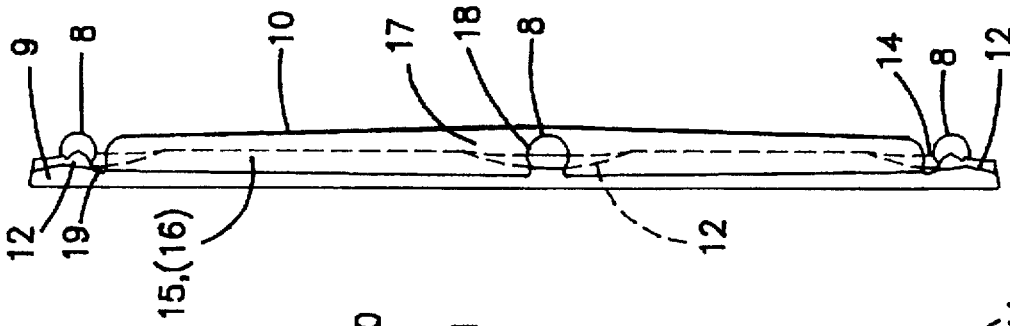
FIG. 3 shows a cross section of the lettering plate according to line III—III of FIG. 2, FIGS. 4 and 5 show side views of a second embodiment of a lettering plate during mounting and in the mounted state.
Figure 2:
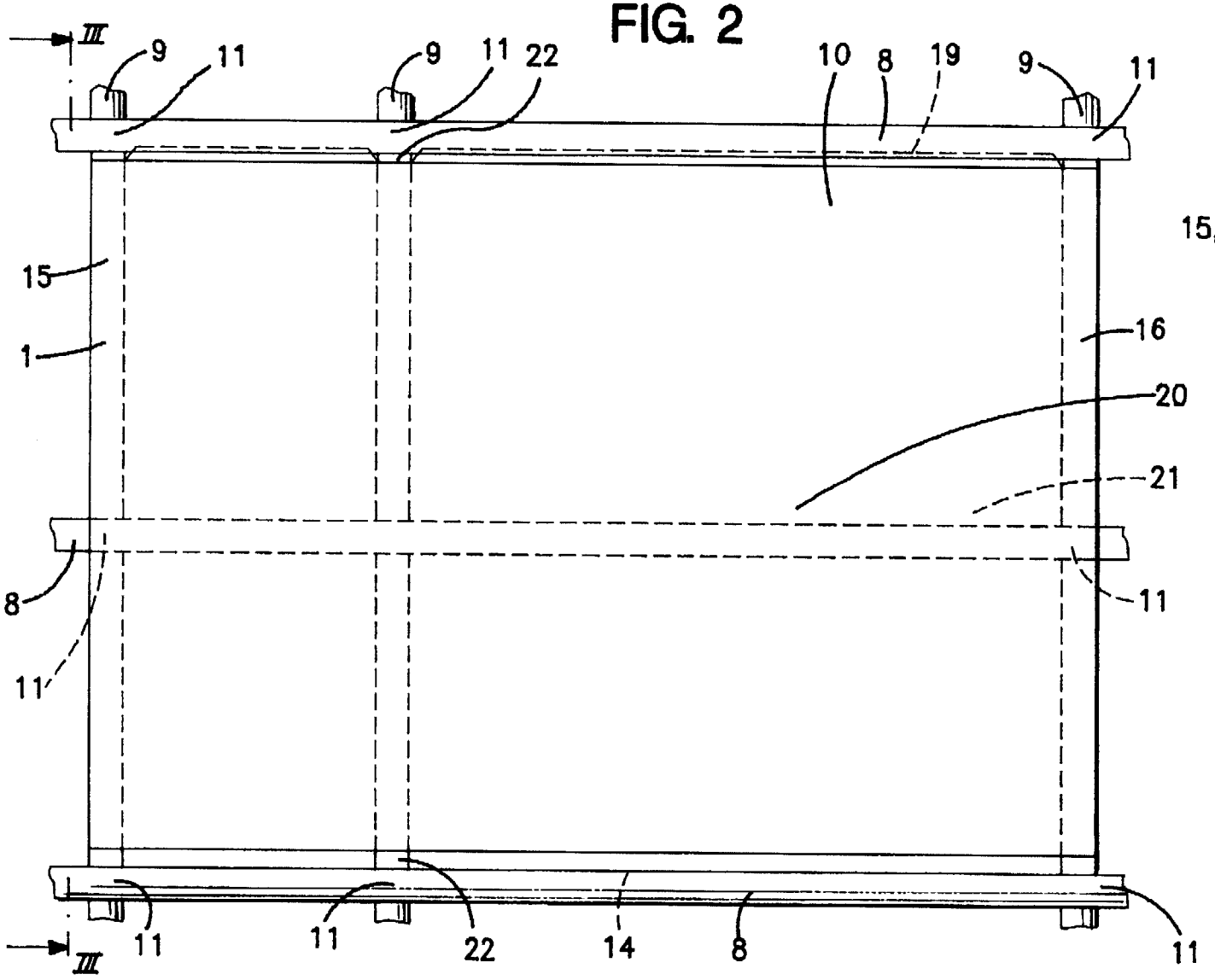
FIG. 2 shows a front view of a first embodiment of the lettering plate according to the invention in an enlarged representation.

Lettering plate 10 which is to be attached to outside 13 of lattice jacket 7 according to FIGS. 2 and 3 has a lower support edge 14 which is flanged or bevelled to the outside. This lower support edge abuts horizontal lattice rod 8 and reaches behind. The lettering plate has also two side edges 15, 16 which are flanged to the outside for resting on two vertical lattice rods 9. In a central section 1,7 of two side edges 15, 16 there are provided openings 18 to hold horizontal lattice rod 8.

Lettering plate 10 furthermore has an upper edge 19 which is made as a clawed edge and which in the mounted state of lettering plate 10 fits behind horizontal lattice rod 8 thereby resiliently bracing the plate 10 against horizontal lattice rod 8. The horizontal lattice rod abuts the back 21 of the plate in middle plate section 20. The lower and upper edge 14, 19 have, depending on the size of lettering plate 10 and grid division of lattice jacket 7, one or more openings 22 for holding one or more vertical lattice rods 9.

Figure 5:
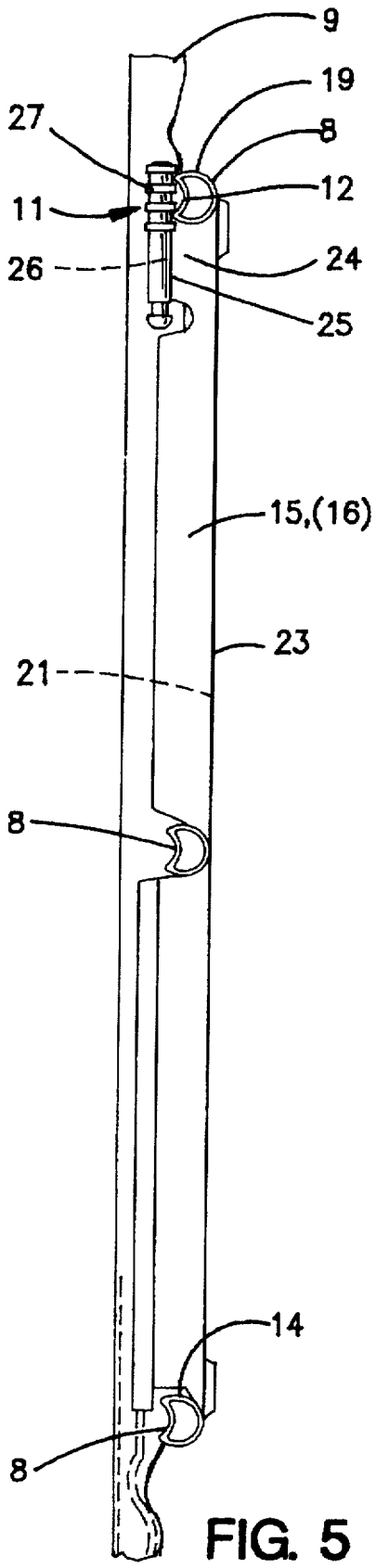
Figure 4:
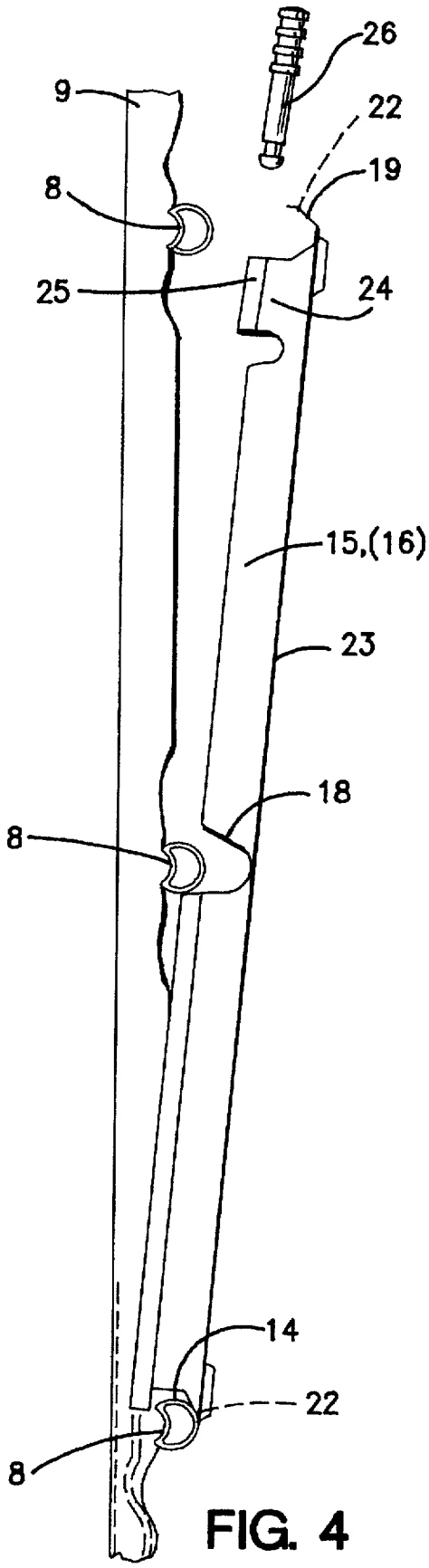
Figure 6:
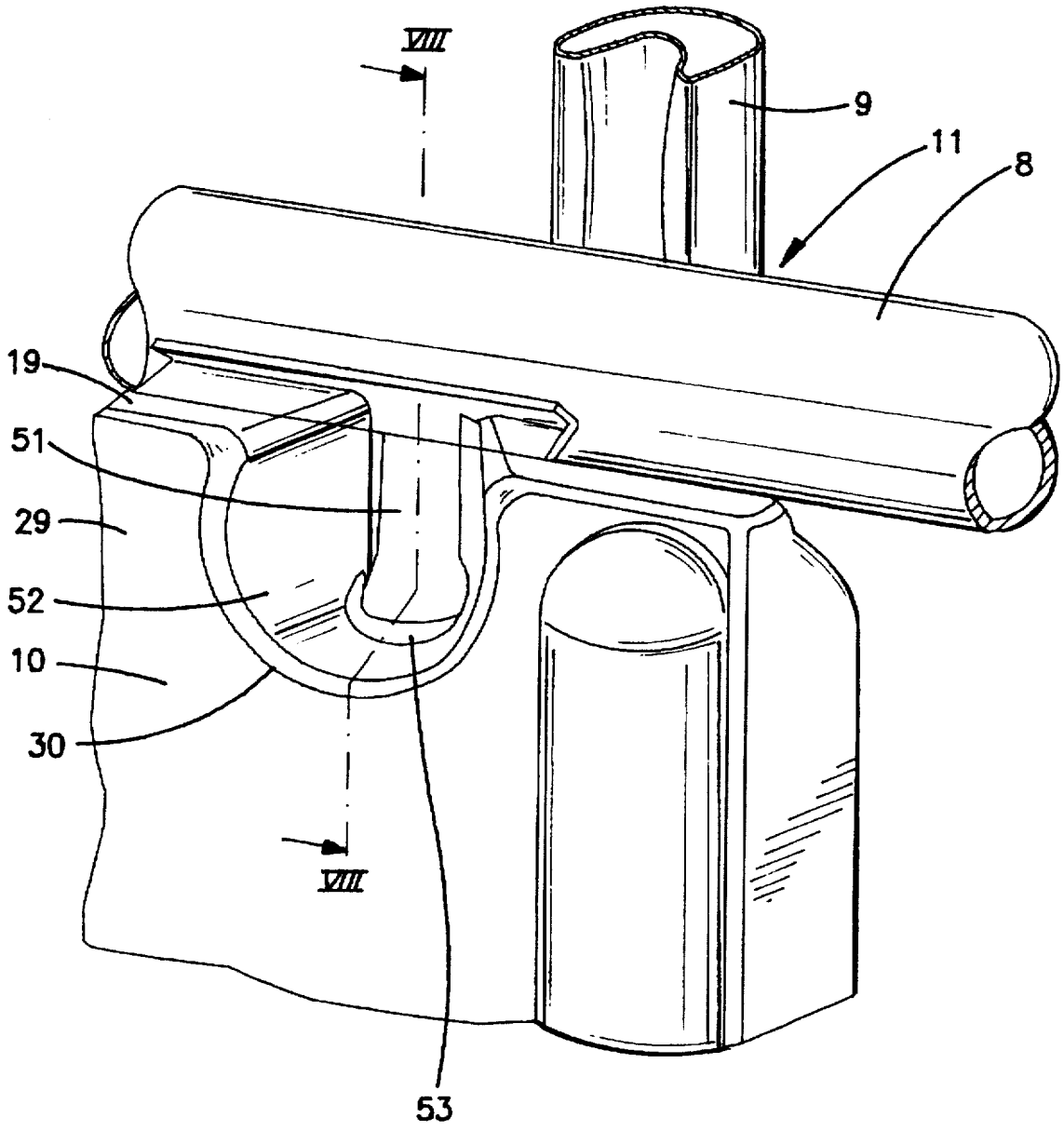
FIG. 6 shows a perspective enlarged representation of a depression formed in the upper edge of the lettering plate in the area of the intersection point of two lattice bars for holding a seal of originality.
Figure 7:
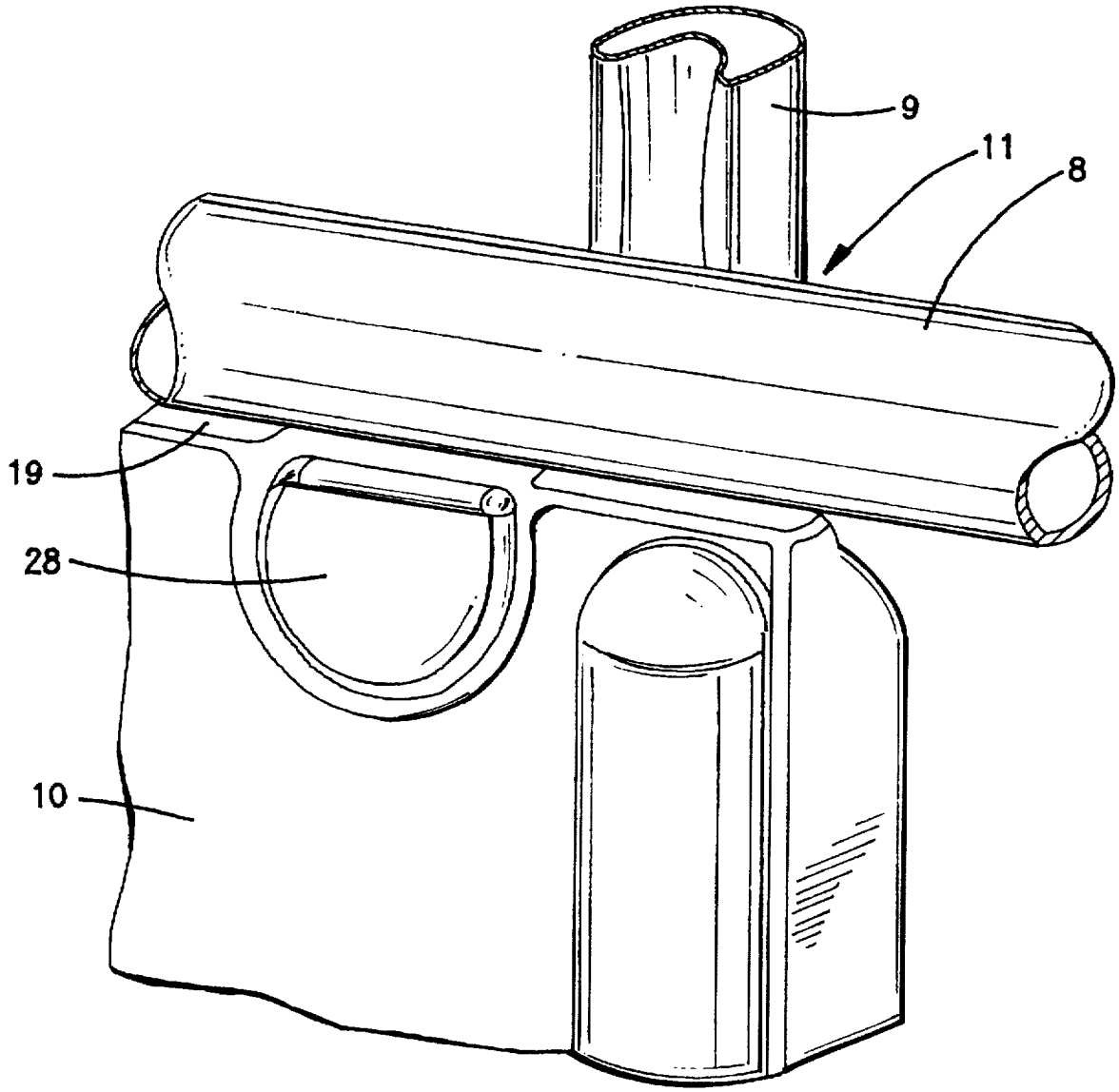
FIG. 7 shows a representation of the upper edge area of the lettering plate secured by a seal of originality in extracts, as corresponds to FIG. 6.
Figure 9:
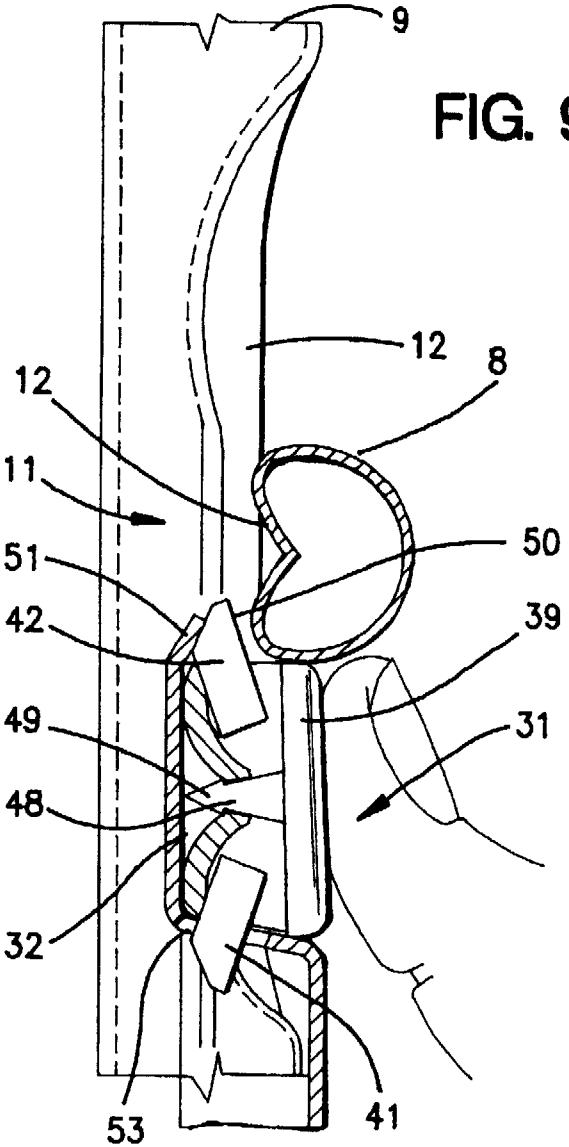
FIG. 9 shows a longitudinal section of the seal of originality which is inserted into the lettering plate.

Lettering plate 23 as seen in FIGS. 4 and 5 has a lower support edge 14 which lies on horizontal lattice rod 8 and which is flanged or bevelled to the inside. The upper edge 19 is flanged to the outside for resting on horizontal lattice rod 8. Two side edges 15, 16 are flanged to the outside for resting on two vertical lattice rods 9. Two insert sleeves 25 are molded in upper corner areas 24 to two side edges 15, 16 for clamp pins 26 which fit in the mounted state of lettering plate 23 with head 27 into trough-shaped depression 12 of horizontal lattice rod 8 at respective intersection point 11 of two lattice rods 8, 9. This arrangement serves to clamp lettering plate 23 with the upper edge 19 on horizontal lattice rod 8. Lower support edge 14, side edges 15, 16 and upper edge 19 of lettering plate 23, depending on the size of plate 23 and grid division of lattice jacket 7, have one or more openings 22, 18 for holding vertical and horizontal lattice rods 8, 9. The lettering plate 23 abuts with bottom 21.

Lettering plate 10, 23 can be equipped with seal of originality 28 which is explained using FIGS. 6 through 9, especially when the plates are provided with an embossed registration number, a test mark or the like.

Seal of originality 28 is inserted into depression 30 which is molded into outside 29 of plate 10 in upper edge 19 of lettering plate 10 in the area of intersection point 11 of two lattice rods 8, 9.

Security element 31 of seal of originality 28, which is produced as a plastic injection molding, consists of bottom 32 with center hollow web 33. The web is like a spreading wedge, and has one center conical receiving hole 34 and two side sloped surfaces 35, 36, two spaced stops 37, 38, are molded to the side sloped surfaces.

Two spaced bolts 41, 42 are attached to push button 39 by means of film hinges 40. The free ends 43, 44 of the bolts have sloped countersurfaces 45, 46 which correspond to sloped surfaces 35, 36 on web 33 of bottom 32 and which are joined by means of tear-off webs 47 to web 33 of bottom 32, between two bolts 41, 42. The conical journal 48 with undercut catch projection 49 is molded to push button 39.

When push button 39 of security element 31 which is inserted into depression 30 in lettering plate 10 is pushed against stops 37, 38 on bottom 32 of the latter, tear-out webs 47 between bolts 41, 42 of push button 39 and web 33 of bottom 32 are destroyed, and bolts 41, 42 which strike sloped surfaces 35, 36 of web 33 with their front sloped surfaces 45, 46 are spread apart, one bolt 42 locking into one gap 50 between tilted bottom 51 of depression 30 in lettering plate 10 and trough-shaped depression 12 of horizontal lattice rod 8, and other bolt 41 locking into corresponding slot 53 in inner edge 52 of depression 30 of lettering plate 10, and catch projection 49 of conical journal 48 which is molded to push button 39 and which is immersed into conical hole 34 of web 33 on lower part 32, locking to the latter.

I claim:

1. In a pallet container used to transport and store liquids and which is equipped with a flat pallet, an interchangeable inner plastic container having an upper sealable fill opening and a lower drain opening with a discharge means, and an outer lattice jacket which surrounds the plastic inner container and which consists of vertical and horizontal metal lattice rods which support the plastic inner container filled with liquid, the lattice rods being recessed at intersection points to form trough-shaped depressions which run in a longitudinal direction of the lattice rods such that the lattice rods which are welded to one another at the intersection points lie almost in one plane, the improvement which comprises a lettering plate adapted to be mounted on an outer surface of the lattice jacket, and comprising:

a lower support edge outwardly flanged for abutting and reaching behind a horizontal lattice rod, two side edges outwardly flanged for resting on two vertical lattice rods, each of said two side edges having in a central section at least one opening for holding a horizontal lattice rod, and an upper edge made for fitting behind a horizontal lattice rod thereby resiliently bracing the lettering plate against the horizontal lattice rod which in a middle plate section abuts its bottom, the lower and upper edge of the lettering plate having, depending on the size of the plate and grid division of the lattice jacket, one or more openings for holding one or more vertical lattice rods.

2. Lettering plate for a pallet container used to transport and store liquids and which is equipped with a flat pallet, an interchangeable inner plastic container having an upper sealable fill opening and a lower drain opening with a discharge means, and an outer lattice jacket which surrounds the plastic inner container and which consists of vertical and horizontal metal lattice rods which support the plastic inner container filled with liquid, the lattice rods being recessed at intersection points to form trough-shaped depressions which run in a longitudinal direction of the lattice rods such that the lattice rods which are welded to one another at the intersection points lie almost in one plane, the lettering plate adapted to be mounted on an outer surface of the lattice jacket, and comprising:

a lower support edge inwardly or downwardly flanged for lying on a horizontal lattice rod, an upper edge outwardly flanged for resting on a horizontal lattice rod, two side edges outwardly flanged for resting on two vertical lattice rods, and two insert sleeves molded in upper corner areas to two side edges each insert sleeve being structured and arranged to accommodate a clamp pin, each said clamp pin having a head for fitting into a trough-shaped depression of a horizontal rod at one of the intersection points thereby clamping the lettering plate with the upper edge on a horizontal lattice rod, said side edges, upper edge and lower edge of the lettering plate, depending on the size of the plate and grid division of the lattice jacket, having one or more openings for holding vertical and horizontal lattice rods.

3. Lettering plate for a pallet container used to transport and store liquids and which is equipped with a flat pallet, an interchangeable inner plastic container having an upper sealable fill opening and a lower drain opening with a discharge means, and an outer lattice jacket which surrounds the plastic inner container and which consists of vertical and horizontal metal lattice rods which support the plastic inner container filled with liquid, the lattice rods being recessed at intersection points to form trough-shaped depressions which run in a longitudinal direction of the lattice rods such that the lattice rods which are welded to one another at the intersection points lie almost in one plane, the lettering plate adapted to be mounted on an outer surface of the lattice jacket, and comprising:

a seal of originality, at least one depression molded on an outer surface of the lettering plate on an upper edge thereof in an area of one intersection point of two lattice rods, said depression being structured and arranged to hold a security element produced as a plastic injection molding, said security element having a bottom with a center hollow web functioning as a spreading wedge, said hollow web having one center conical receiving hole and two side sloped surfaces, each of said side sloped surfaces having a spaced stop molded thereto, and a push button having two spaced bolts attached thereto via film hinges, free ends of the bolts having sloped counter surfaces which correspond to the side sloped surfaces, said sloped counter surfaces being joined via tear-off webs to the hollow web of the bottom, a conical journal having an undercut catch projection molded to the push button between the two bolts, such that when the push button of the security element is inserted into the depression, and pushed against the stops, the tear-off webs between the bolts and the hollow web are destroyed, and the bolts which strike the side sloped surfaces of the hollow web with their sloped counter surfaces are spread apart, one bolt locking in one gap between a slanted bottom of the depression on the outside of the lettering plate and the trough-shaped depression of a horizontal lattice rod, and the other bolt locking into a corresponding slot in an inner edge of the depression, and the catch projection of the conical journal which is immersed into the conical hole of the hollow web locking to the bottom.

* * * * *